US006609737B2

(12) United States Patent
Fisher

(10) Patent No.: US 6,609,737 B2
(45) Date of Patent: Aug. 26, 2003

(54) LOCK ARRANGEMENT

(75) Inventor: Sidney Edward Fisher, West Midlands (GB)

(73) Assignee: Meritor Light Vehicle Sytems ( UK) Limited (GB)

( * ) Notice: Subject to any disclaimer, the term of this patent is extended or adjusted under 35 U.S.C. 154(b) by 0 days.

(21) Appl. No.: 09/995,535

(22) Filed: Nov. 28, 2001

(65) Prior Publication Data

US 2002/0074809 A1 Jun. 20, 2002

(51) Int. Cl.[7] ..... E05C 3/06; E05C 3/16

(52) U.S. Cl. ..... 292/216; 292/201; 292/DIG. 23; 292/DIG. 4

(58) Field of Search ..... 292/DIG. 23, 201, 292/216, 336.3, DIG. 4; 401/99–117, 110

(56) References Cited

U.S. PATENT DOCUMENTS

| | | | | | |
|---|---|---|---|---|---|
| 3,051,132 | A | * | 8/1962 | Johmann | 401/103 |
| 3,291,101 | A | * | 12/1966 | Helitas | 401/110 |
| 3,464,774 | A | * | 9/1969 | Vetter | 401/110 |
| 4,836,588 | A | * | 6/1989 | Simoncelli et al. | 292/34 |
| 4,889,373 | A | * | 12/1989 | Ward et al. | 292/336.3 |
| 5,005,885 | A | * | 4/1991 | Kobayashi et al. | 292/336.3 |
| 5,050,922 | A | * | 9/1991 | Falcoff | 296/37.7 |
| 5,123,687 | A | * | 6/1992 | Pfeiffer et al. | 292/336.3 |
| 5,267,761 | A | * | 12/1993 | Curtindale et al. | 292/81 |
| 5,676,409 | A | * | 10/1997 | Trammell, Jr. | 292/336.3 |
| 5,681,068 | A | * | 10/1997 | Kleefeldt et al. | 292/336.3 |
| 5,683,125 | A | * | 11/1997 | Tseng | 292/216 |
| 5,688,001 | A | * | 11/1997 | Klein et al. | 292/67 |
| 5,853,060 | A | * | 12/1998 | Chao et al. | 180/69.2 |
| 5,921,595 | A | * | 7/1999 | Brackmann et al. | 292/216 |
| 6,158,788 | A | * | 12/2000 | Ikeda et al. | 292/216 |
| 6,264,254 | B1 | * | 7/2001 | Siegfried et al. | 292/336.3 |
| 6,377,005 | B1 | * | 4/2002 | Zintler et al. | 318/9 |
| 6,431,617 | B1 | * | 8/2002 | Fisher | 292/216 |
| 6,439,624 | B1 | * | 8/2002 | Spurr | 292/201 |
| 6,445,081 | B1 | * | 9/2002 | Franz | 307/10.1 |
| 6,460,905 | B2 | * | 10/2002 | Suss | 292/336.3 |

FOREIGN PATENT DOCUMENTS

| | | |
|---|---|---|
| EP | 0 267 423 A2 | 5/1988 |
| EP | 0 665 352 A1 | 8/1995 |

* cited by examiner

*Primary Examiner*—Robert J. Sandy
*Assistant Examiner*—Matthew E. Rodgers
(74) *Attorney, Agent, or Firm*—Carlson, Gaskey & Olds

(57) ABSTRACT

A lock arrangement including a lock having an unlocked and locked condition, the lock arrangement further including an actuable element having a first position at which the lock is unlocked and a second position at which the lock is locked, the lock arrangement further including means for ensuring the actuable element passes through a transitory position in changing the state of the lock from at least one of the locked and unlocked conditions to the other of the locked and conditions in which one of the locked and unlocked conditions of the actuable element is on the path of the actuable element between the transitory and the other of the locked and locked positions.

23 Claims, 8 Drawing Sheets

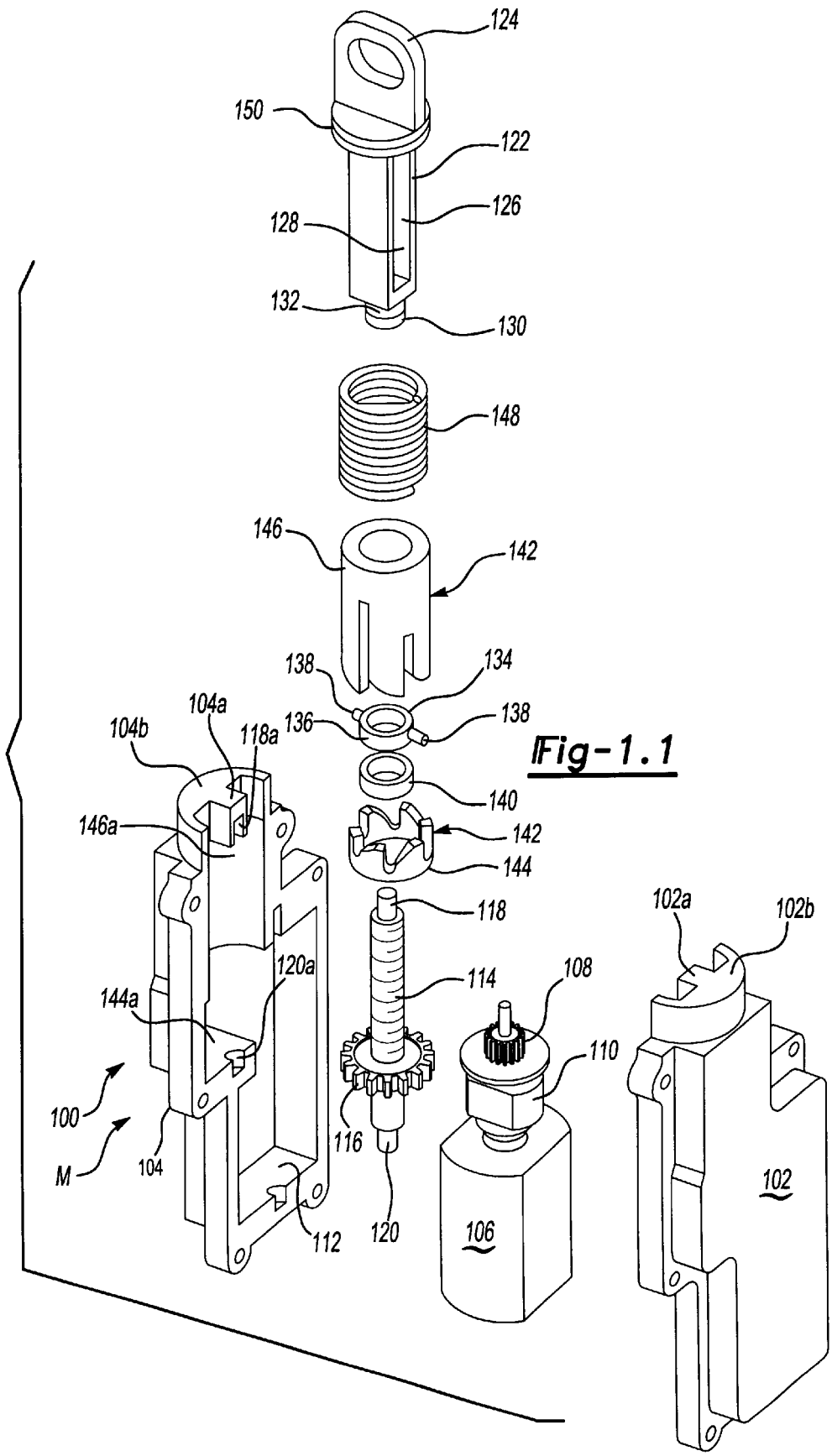
Fig-1.1

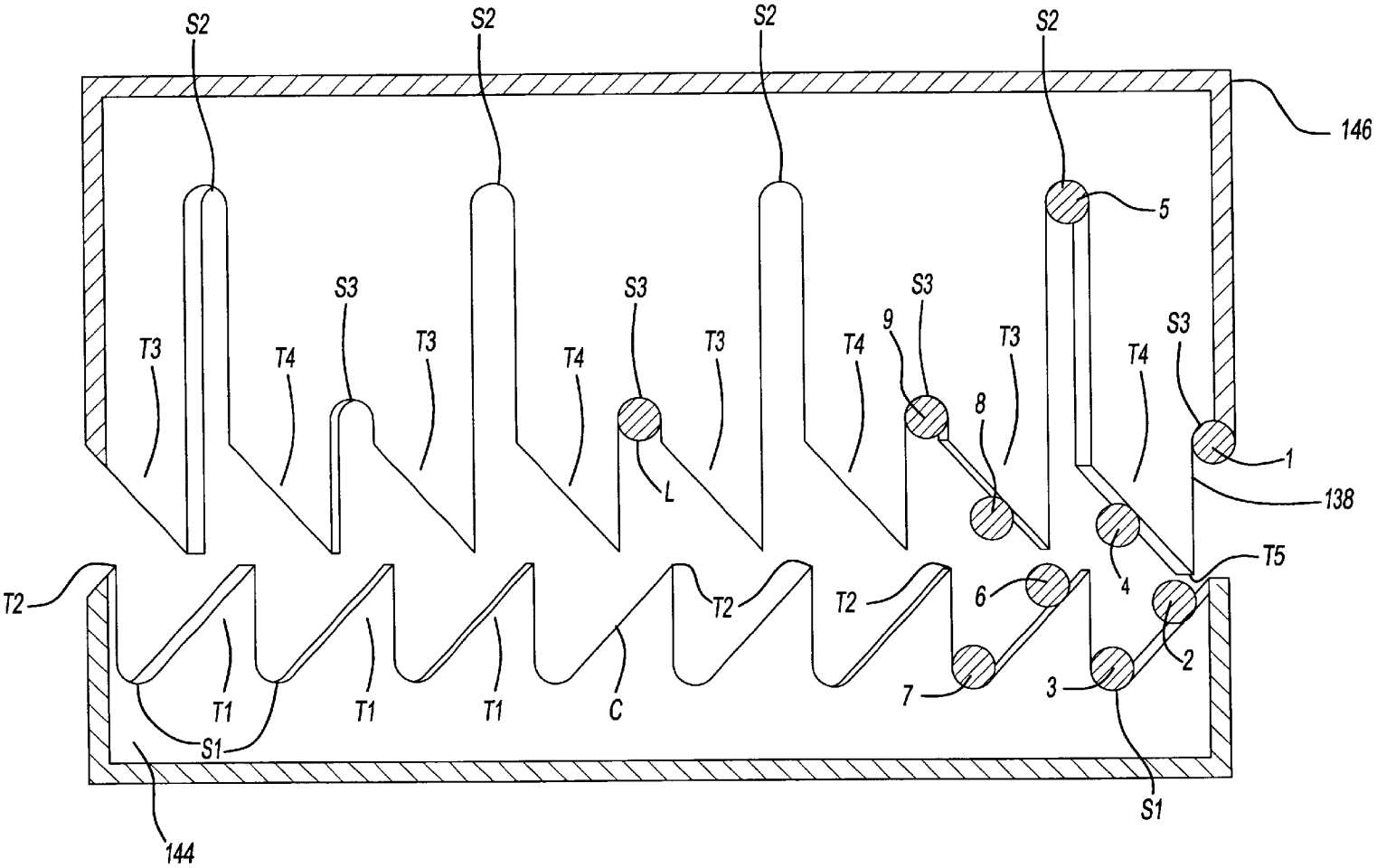
Fig-1.2

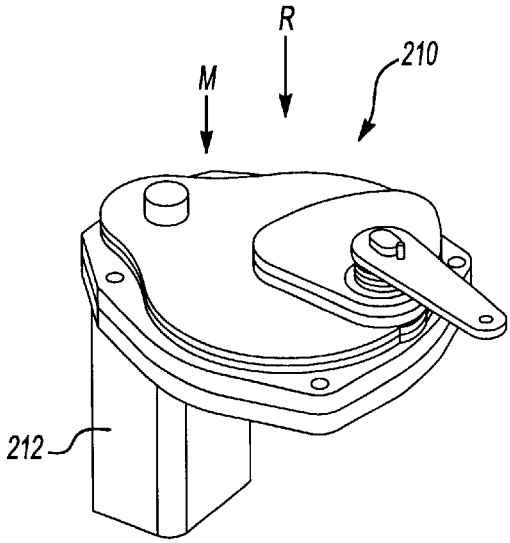
Fig-2.1
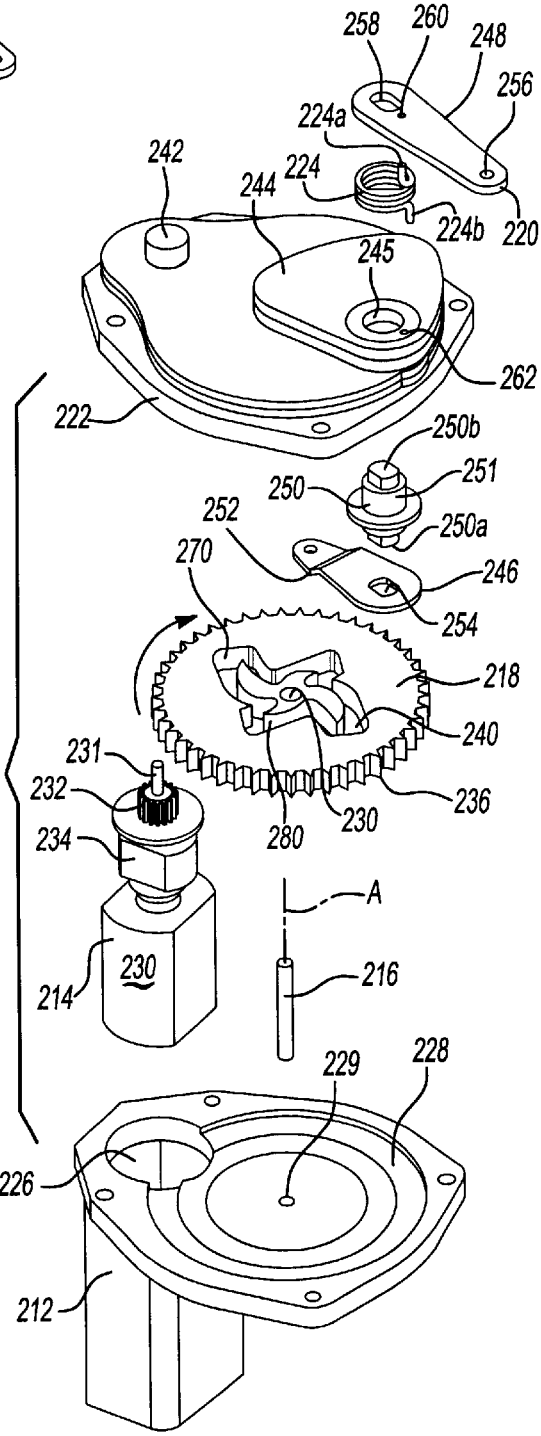
Fig-2.2
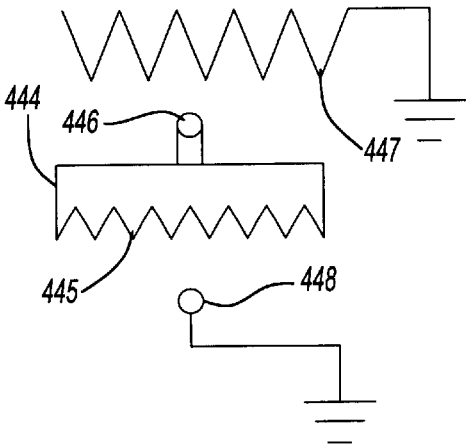
Fig-1.3

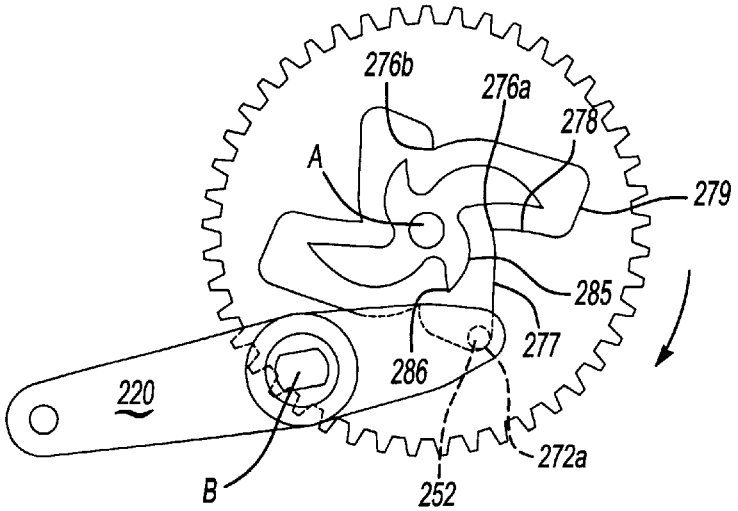
Fig-2.3
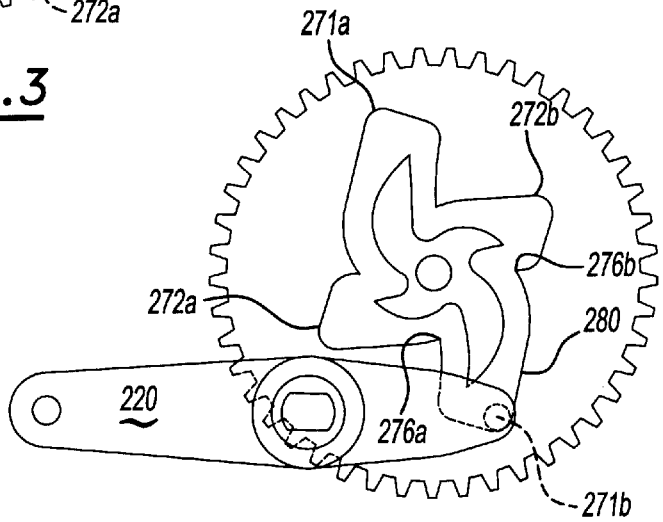
Fig-2.4
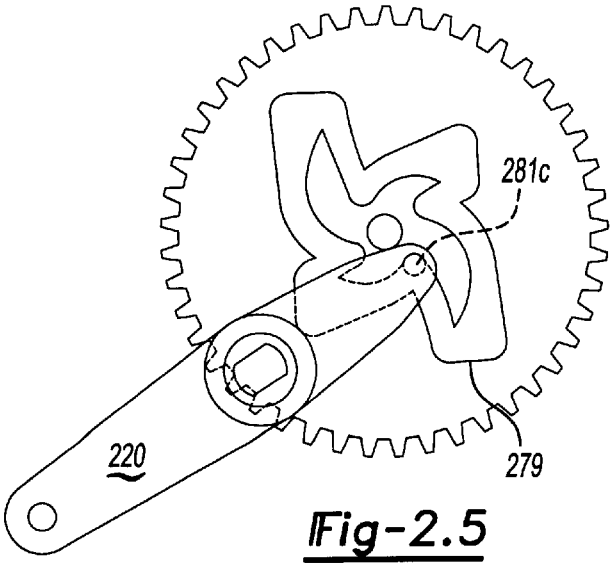
Fig-2.5

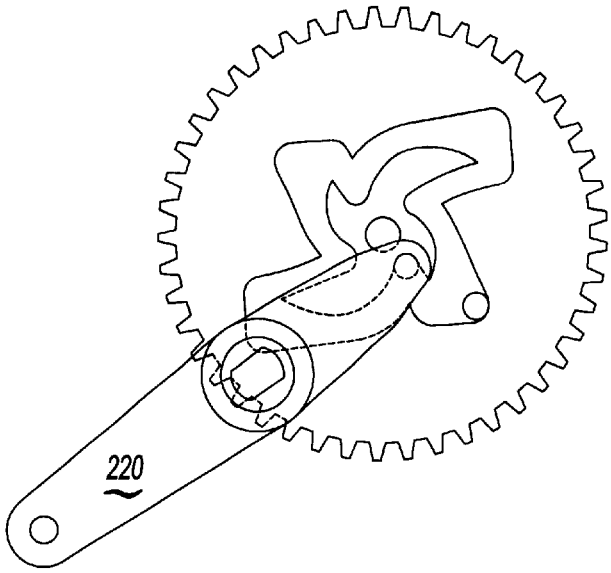
Fig-2.6
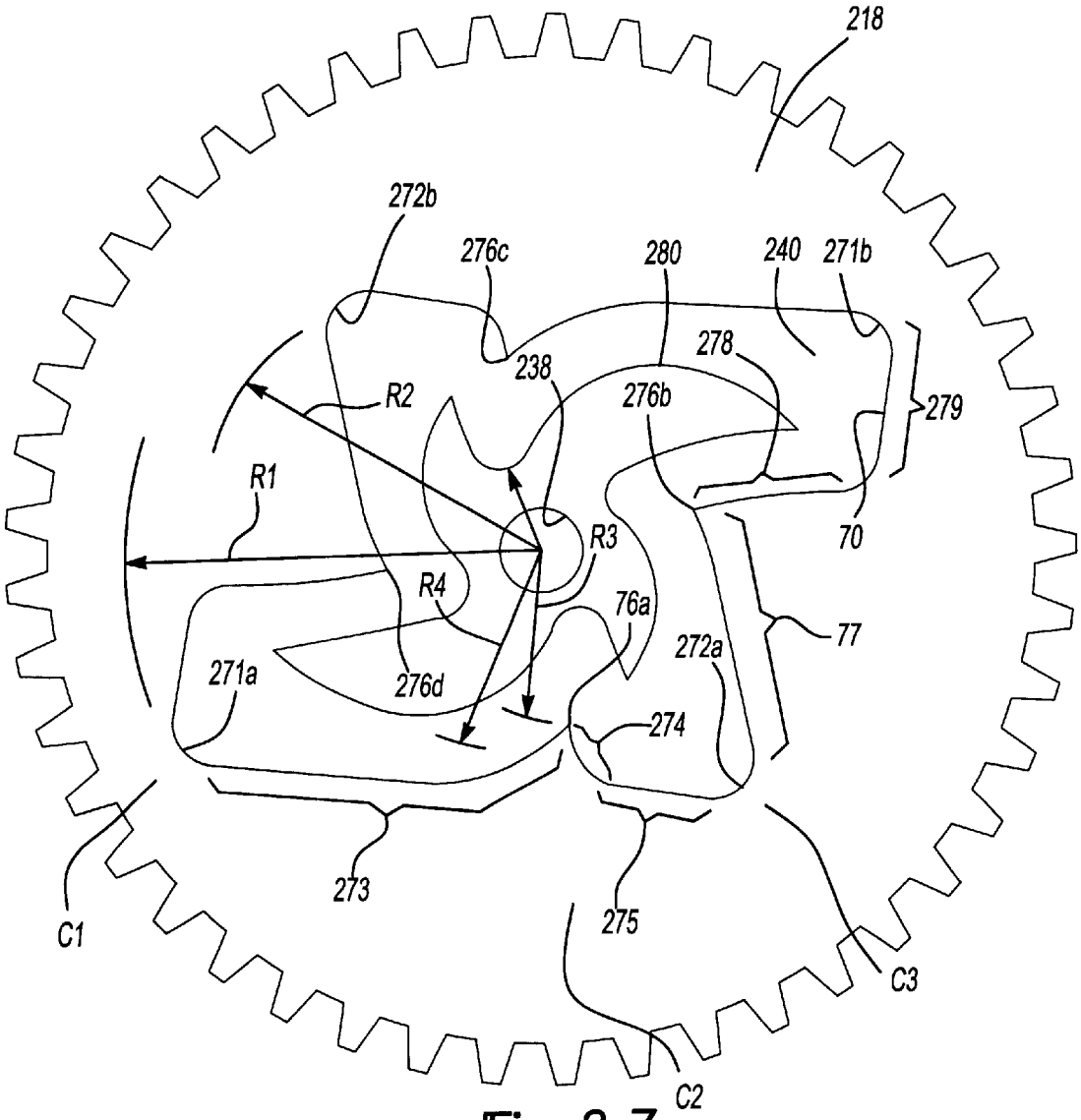
Fig-2.7

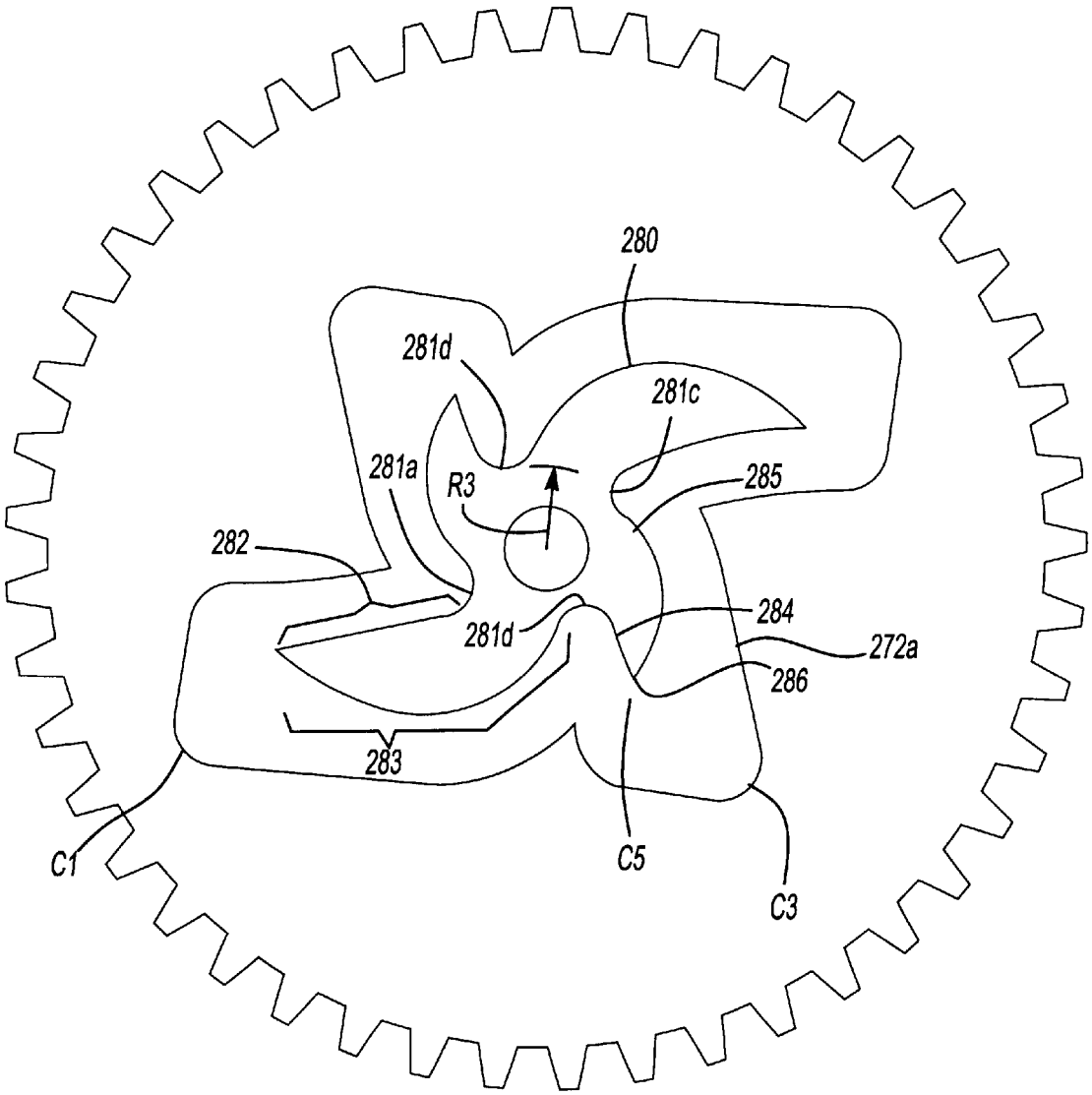
Fig-2.8

LOCK ARRANGEMENT

BACKGROUND OF THE INVENTION

The present invention relates to lock arrangements, and in particular lock arrangements for use in cars (automobiles).

Known car doors include an inside release handle operable to open the car door, and also operable to lock the car door. The handle has three positions with the door release position being at one extreme and the lock position being at the other extreme, with the unlocked (but not released) position been part way between the locked and released positions.

Thus when the handle is in the unlocked position, movement of the handle to the release position opens the door. Furthermore when the handle is in locked position it is possible to move the handle as a single operation through the unlocked position to the release position. This is the normal sequence of events when the car is stationary and locked and an occupant of the vehicle wishes to exit the vehicle.

However, an occupant wishing to unlock the door (without opening the door) would normally move the handle from the locked to the unlocked position but can inadvertently move the handle pass the unlocked position to the release position. If this inadvertent operation is carried out whilst the vehicle is travelling at speed then there is a danger of the door opening with obvious safety implications of the occupants of the vehicle.

SUMMARY OF THE INVENTION

An object of the present invention is to provide an improved form of lock arrangement.

Thus according to the present invention there is provided a lock arrangement including a lock having an unlocked and locked condition, the lock arrangement further including an actuable element having a first position at which the lock is unlocked and a second position at which the lock is locked, the lock arrangement further including means for ensuring the actuable element passes through a transitory position when changing the state of the lock from at least one of the locked and unlocked conditions to the other of the locked and conditions in which one of the locked and unlocked conditions of the actuable element is on the path of the actuable element between the transitory and the other of the locked and locked positions.

BRIEF DESCRIPTION OF THE DRAWINGS

The invention will now be described, by way of example only, with reference to the accompanying drawings in which:

FIG. 1.1 is an exploded view of a means of the present invention;

FIG. 1.2 is a developed view of the cam arrangements of FIG. 1.1;

FIG. 1.3 is a partial schematic view of a further embodiment of a means of the present invention;

FIG. 2.1 is a view of a means of the present invention;

FIG. 2.2 is an exploded view of FIG. 2.1;

FIGS. 2.3 to 2.6 show an axial view of some of the components of the means of FIG. 2.1 in various positions;

FIG. 2.7 shows an axial view of the cam arrangement of FIG. 2.1 in isolation; and FIG. 2.8 shows a partial view of FIG. 2.7.

DETAILED DESCRIPTION OF THE PREFERRED EMBODIMENT

Figure 1:
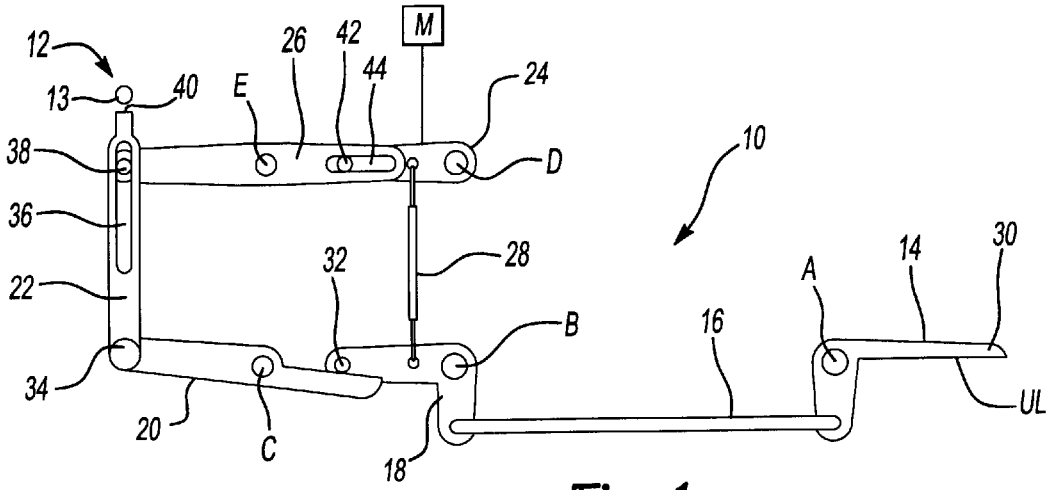
FIGS. 1 to 4 show a view of a lock arrangement according to the present invention in an unlocked, locked, transitory and unlatched position.

With reference to FIGS. 1 to 5 there is shown a lock arrangement 10 which incorporates a latch 12, only part of which is shown. Lock arrangement 10 includes an inside handle 14, a link 16, and inside release lever 18, an outside release lever 20, a common release lever 22, an inside lock lever 24, an outside lock lever 26 and an extension spring 28.

Inside handle 14 is pivotally mounted about axis A on the inside of a door and includes a manually actuable portion 30. Inside handle 14 is connected to inside release lever 18 by link 16. Inside release lever 18 is pivotally mounted about axis B and includes a pin 32 for engagement with outside release lever 20. Inside release lever 18 is further connected to inside lock lever 24 via extension spring 28. Outside release lever 20 is pivotally mounted about axis C and is connected via a connection (not shown) to an outside door handle (not shown).

A pivot pin 34 operably connects outside release lever 20 to common release lever 22, allowing the common release lever 22 to pivot relative to the outside release lever 20.

Common release lever 22 includes an elongate slot 36 within which moves pin 38 of outside lock lever 26. Common release lever 22 further includes a release abutment 40 for engagement with the pin 13 of latch 12.

Extension spring 28 includes helical coils which are normally coil bound. As such it can act as a rod of fixed length in compression. It can also act as a rod of fixed length under tension when the tensile load is less than that required to separate the coils of the spring, following which it becomes extensively elastic.

Inside lock lever 24 is pivotally mounted about axis D and includes a pin 42 which moves within slot 44 of outside lock lever 26. Outside lock lever 26 is pivotally mounted about axis E. A means M (shown schematically in FIG. 1) is connected to the inside lock lever, the purpose of which will be described further below.

Latch 12 is of known construction and typically might include a rotationing claw (latch bolt) which releasably engages a striker mounted on fixed structure of the vehicle such as a B post or a C post. The claw is retained in a closed position by a pawl operably connected to pin 13. Movement of pin 13 from the latch position LA (see FIG. 5) to the release position R causes the pawl to disengage the claw, thus allowing the striker to be released and hence the allowing the door to open.

Figure 5:
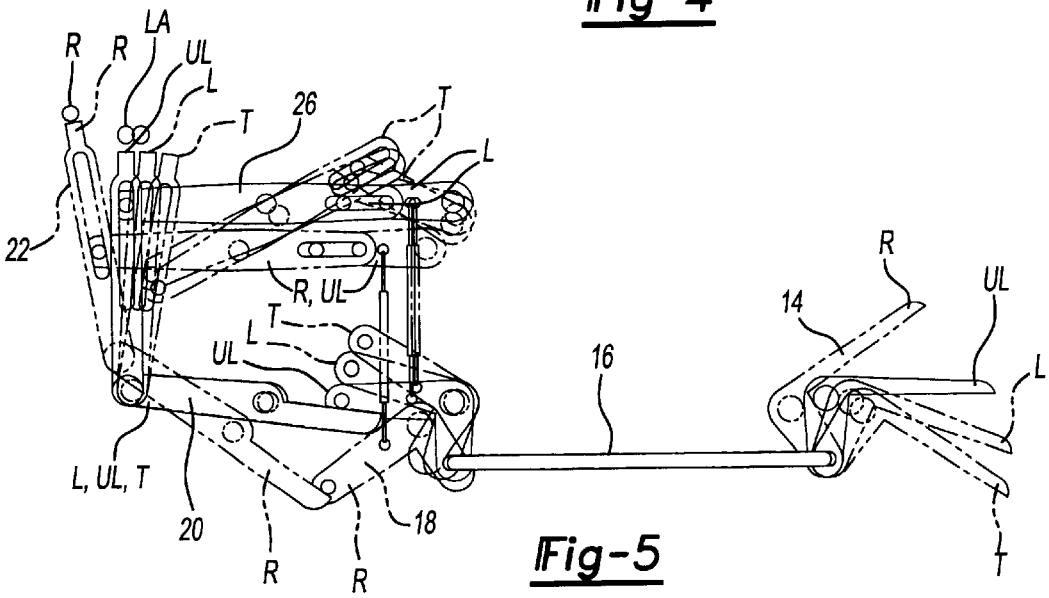
FIG. 5 shows the views of FIGS. 1 to 4 overlaid for comparison purposes.

Consideration of FIG. 5 shows the various components of the lock arrangement in various positions wherein R refers to the released position of a particular component, U refers to the unlocked position of the particular component, L refers to the locked position of a particular component and T refers to the transitory position of a particular component. It should be noted that inside handle 14, inside release lever 18, and common release lever 22 each have four positions. However, outside release lever 20 remains in the same position when the lock arrangement is in a locked, unlocked or transitory position. The outside release lever 20 only moves from this position to the release position when the latch is released.

It should also be noted that the outside lock lever 46 and inside lock lever 24 remain in the same position when the lock arrangement is in the released or unlocked condition. However, these two components do move to a locked position and also to a different transitory position.

Figure 4:
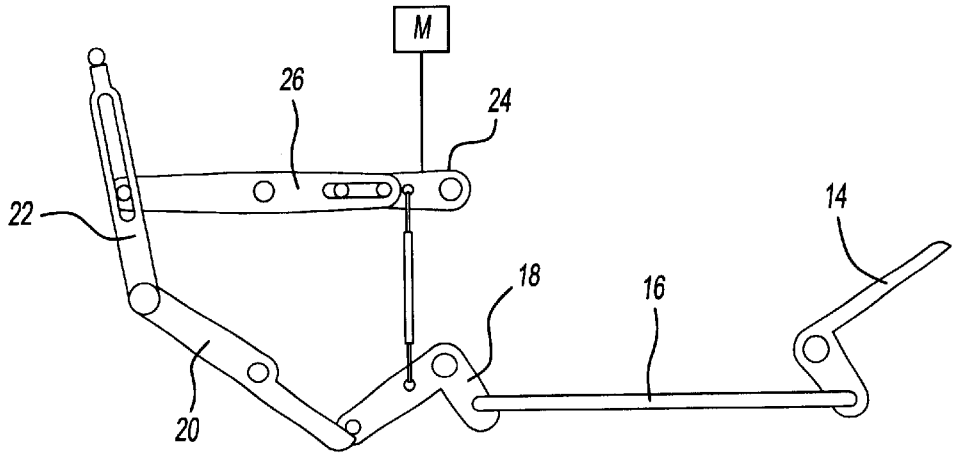

Consideration of FIG. 1 shows the lock arrangement in an unlocked condition. Thus movement of the inside handle to the released position causes the link 16 to rotate the inside release lever anticlockwise about axis B causing pin 32 to engage outside release lever 20 causing it in turn to rotate clockwise about axis C which results in pivot pin 34 moving common release lever 22 generally vertically when viewing FIG. 1 such that release abutment 40 engages and moves pin 13 to the released position as shown in FIG. 4. It should be noted that during this release movement pin 38 retains stationary and slides within slot 36 and extension spring 28 is caused to extend.

The outside release lever 20 can be independently moved by an outside door handle to open the latch and under such circumstances outside release lever 20, common release lever 22 and pin 12 move in a similar manner to that when the inside handle is moved but the inside handle 14, link 16 and inside release lever 18 remains stationary under these circumstances.

Figure 2:
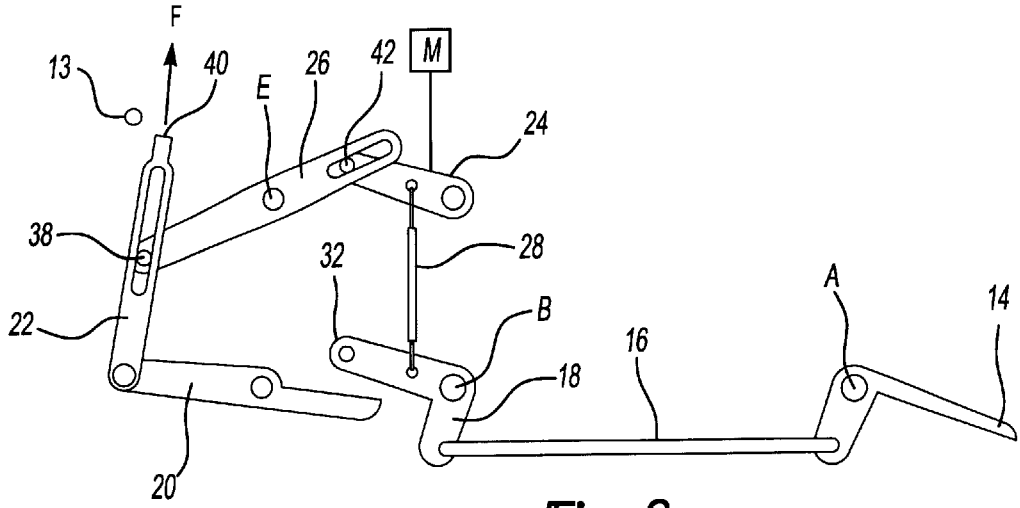

Consideration of FIG. 2 shows the lock arrangement in a locked condition wherein the inside handle 14 has been rotated clockwise about axis A relative to the position as shown in FIG. 1 resulting in inside release lever 18 rotating clockwise causing the extension spring 28 to act in compression as a solid rod which in turn causes the inside lock lever 24 to also rotate clockwise.

The clockwise rotation of the inside lock lever 24 has caused the pin 42 to rotate the outside lock lever 26 anticlockwise about axis E resulting in pin 38 causing the combined release lever 22 to rotate clockwise when compared with FIG. 1. It should be noted that the position of the outside release lever 20 has shown in FIGS. 1 and 2 remains unchanged. Furthermore consideration of FIG. 2 shows that the release abutment 40 is no longer in line with pin 13. Thus operation of the outside door handle to move the outside release lever will result in the common release lever 22 moving in the direction of arrow F such that release abutment 40 bypasses pin 13 and hence the latch is not released.

Furthermore if the inside handle 14 where to be moved to the release position link, 16 would cause inside release lever 18 to rotate anticlockwise such that pin 32 is caused to contacted and rotated outside release lever 20 in a clockwise direction and again release abutment 40 would move in the direction of arrow F bypassing pin 13. Under these circumstances means M prevents the inside lock lever from moving to its unlocked position (as will be further described below) and hence extension spring 28 is caused to extend when an attempt is made to open the latch by the inside handle when the latch assembly is in the locked condition as shown in FIG. 2.

Figure 3:
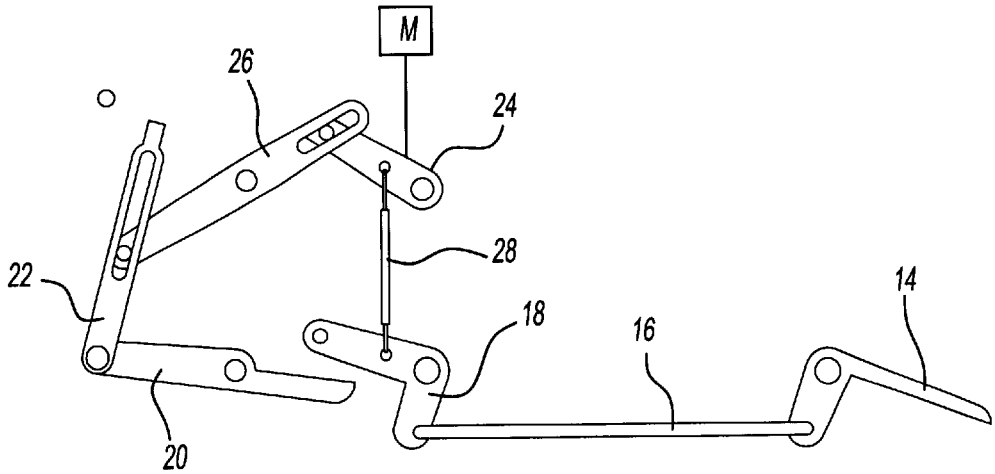

Consideration of FIG. 3 (when compared with FIG. 2) shows that the inside handle 14 has been moved to a transitory position. This in turn has caused link 16, inside release lever 18, extension spring 28, inside lock lever 24, outside lock lever 26 and common release lever 22 to also all move to a transitory position. Note that the outside release lever 20 remains in the same position as shown in FIGS. 1 and 2.

Means M acts in such a manner as to prevent the inside lock lever 24 moving directly from its locked to its unlocked position or from its unlocked position to its locked position.

In particular is should recognised that the unlocked and locked positions of the lock arrangement are stable position, that is to say when the lock arrangement is manually put into either of these position it will remain there. That can be contrasted with the release position wherein when the inside release handle is pulled to that position with the door in an unlocked condition the door latch opens and when the occupant of the vehicle releases the inside handle it returns (usually under the influence of a spring) to the unlocked position. The release position can therefore be said to be an unstable condition. The transitory position is also an unstable conditions (though in further embodiments this need not be the case).

The means M acts such that with the inside lock lever 24 in a locked condition, the inside lock lever must move to the transitory position prior to moving to the unlocked position. Furthermore the means M also acts such that with the inside release lock lever in the unlocked position the inside lock lever must move to the transitory position prior to moving to the locked position.

With this functioning of means M in mind, consideration of FIG. 2 shows that if the inside handle 14 where to be pulled fully to the released position inside lock lever 24 does not move, even as extension spring 28 extends as inside release lever 18 rotates anticlockwise about axis B.

To release a locked door by operation of the inside release handle 14, it is necessary to first push the inside handle to its transitory position which in turn moves link 16, inside release lever 18, extension spring 28, and most notably inside lock lever 24 to their respective transitory positions. Once inside lock lever 24 has achieved its transitory position, means M then allows it to move to its unlocked position as shown in FIG. 1 as the inside handle is returned to its unlocked position. Further movement of the inside handle in an anticlockwise direction to its released position now allows the mechanism to release the latch.

Thus unlatching of the latch from the locked position as shown in FIG. 2 requires three distinct operations to be performed by an occupant of the vehicle, namely:

pushing the inside handle to the transitory position, releasing the inside handle (whereupon it moves to the unlock position under the influence of a basis spring (not shown)), pulling the inside handle 14 to the released position.

In particular it can be seen that such an operation requires one pushing operation and a further pulling operation and as such an occupant of the vehicle who merely wishes to unlock the door (but not to unlatch the door) simply has to push the inside handle and is therefore less likely to inadvertently release the latch since this requires a further pull operation.

Figure 6:
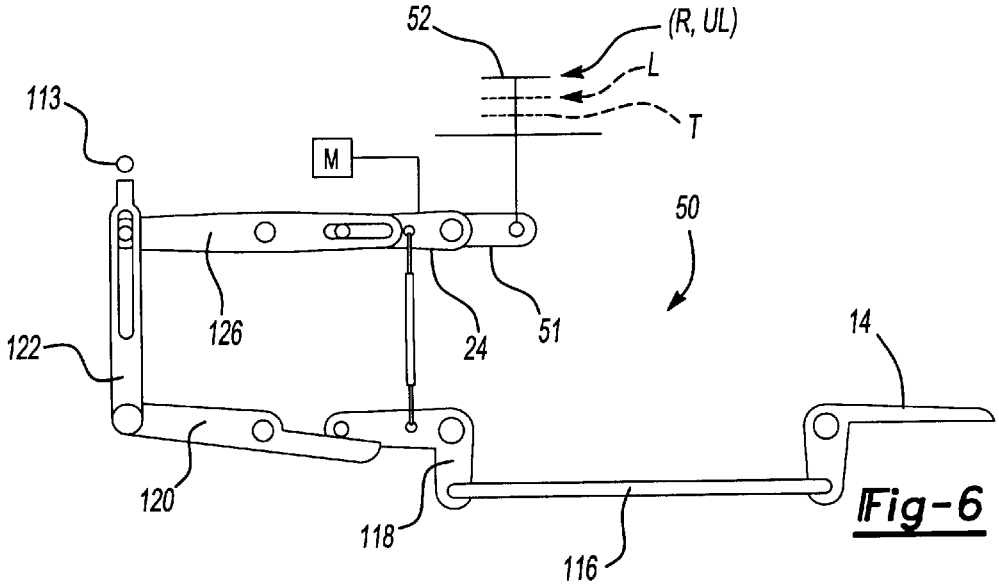
FIG. 6 is a view of a further embodiment of a lock arrangement according to the present invention.

Consideration of FIG. 6 shows a further embodiment of a lock arrangement 50 with components that perform substantially the same function as those in lock arrangement 10.

In this case lock arrangement 50 does not include an extension spring equivalent to extension spring 28. Furthermore, inside lock lever 24 has an extension connected to a sill button 52. As shown in FIG. 6 sill button 52 is in a raised unlocked position UL. The lock arrangement 50 can be locked by pressing the sill button to its transitory position T and then releasing the sill button whereupon it will return under the influence of a spring (not shown) to the locked condition L. To unlock the sill button is again pushed to the transitory position T and released whereupon it returns to the unlocked position UL.

Advantageously such an arrangement allows locking/unlocking to be performed by pushing operations. In particular the sill button is not required to be gripped and pulled and this is useful to people who have a weak grip such as the elderly and young children.

It can be seen that the lock arrangement 110 only requires the inside handle 14 to have only two positions namely a released position (not shown) and the position of this component as shown in FIG. 6 which remains the same whether the lock arrangement is in a locked, unlocked or transitory position.

There now follows examples of means for ensuring the actuatable element passes through the transitory position.

With reference to FIG. 1.1 there is shown a means M in the form of an actuator 100 having a right and left hand casing 102 and 104 respectively. A motor 106 is capable of driving pinion 108 via centrifugal clutch 110. The motor, pinion and centrifugal clutch are secured in the casings 102 and 104 in recess 112 (only shown for left hand casing 104). In this case the motor is a DC motor, though other motors would be suitable including a electric stepper motor.

A worm screw 114 is rotationally fast with gear 116. Ends 118 and 120 of the worm screw sit in bearing housing 118 and 120 respectively (only shown on left hand casing 104). Worm screw 114 is thus rotatable within the right and left hand casings but axially fast therein. The actuator further includes an output member in the form of a plunger 122 having a first end 124 for connection to components to be actuated. The plunger includes a body portion 126 having an elongate slot 128. At a second end 130 is a spigot 132 having an internal thread (not shown) for engagement with the worm screw 114.

A shuttle in the form of cam follower 134 has an annular body 136 and two diametrically opposed cam follower pins 138. Cam follower 134 is rotatably mounted on spigot 132 and is retained axially in position by cam follower retainer ring 140 also being mounted on spigot 132 and being axially secured thereto. A caming arrangement 142 is provided by first cam ring 144 and second cam ring 146. Each cam ring is generally cylindrical and has an array of teeth around the circumference of one end.

In this case cam ring 144 has eight teeth T1 (see FIG. 1.3), all identical with each tooth having a tooth edge T2. Between adjacent teeth edges T2 there is provided a cam follower stop S1. In this case the axial height of all teeth edges T2 is the same and the axial height of all cam followers stops S1 is the same. Cam ring 146 also has an array of eight teeth, four of which (T3) are of one profile and the remaining four of which (T4) are of a different profile. It should be noted that the teeth edges T5 of all teeth T3 and T4 are at the same axial position. Cam follower stops S2 and S3 are alternately positioned between teeth T4 and T3 with cam follower stops S2 all being at the same axial position which is different from the axial position of cam follower stops S3.

With the actuator 100 in an assembled condition, pinion 108 engages with gear 116 and worm screw 114 engages with the internally threaded hole (not shown) of spigot 132. As mentioned above, worm screw 114 is axially fast within the right and left hand casings thus rotation of worm screw via the motor 106, centrifugal clutch 110, pinion 108 and gear 116 will cause the plunger 122 to move in an axial direction.

Cam ring 144 and 146 are secured rotationally and axially fast in recesses 144A and 146A of the casings. The outer diameter of annular body 136 is a clearance fit within the bore of cam rings 144 and 146. However, cam follower pins 138 are positioned at a radius that allows them to engage the teeth and cam follower stops of the cam rings 144 and 146.

The plunger 122 is assembled into the casings 102 and 104 such that bosses 102A and 104A of the casing sit within elongate slot 128 thus preventing the plunger 122 from rotating in use. A spring 148 abuts rim 60 of plunger 122 and also abuts boss 102B and 104B of the right and left hand casings to bias the plunger in a upward direction when viewing FIG. 1.1.

Upward movement of plunger 122 is limited by contact between cam follower pins 48 and either cam follower stops S2 (where the plunger is in a raised position when viewing FIG. 1.1) or by contact with cam follower stops S3 (where the plunger is in a mid position when viewing FIG. 1.1).

Operation of the actuator is as follows:

It is assumed the start position of one of the cam follower pins 138 is in position 1 of FIG. 1.2 in abutment with cam follower stop 53 (locked). Therefore the other cam follower pin 138 is in position 1A in abutment with a corresponding cam follower S3.

The motor is energised causing the centrifugal clutch 20 to spin and engage whereupon pinion 108 rotates causing gear 116 to rotate and hence worm screw 114 to rotate. Engagement of worm 114 with the internally threaded hole of spigot 132 causes the plunger to move downwards when viewing FIG. 1.1. This downward movement of the plunger causes the cam following pin 138 to move from position 1 as shown in FIG. 1.2 progressively to position 2 whereupon continued downward movement of the plunger causes the cam follower pin 138 to move downward and leftward when viewing FIG. 1.2 such that it achieves the position 3 (transient position) wherein it is in abutment with cam follower stop S1. At this point the motor is stalled and shortly afterwards the power to the motor is cut.

The spring 148 is under sufficient compression such that it can now lift the plunger and hence the cam follower pin 138 moves progressively from the position 3 through position 4 to position 5 (unlocked) as shown in FIG. 1.2. At position 5 the cam follower pin is in engagement with cam follower stop S2 and this then limits the upward movement of the plunger.

When the motor is subsequently energised again the cam, follower pin 138 moves progressively from position 5 through position 6 to position 7 as shown in FIG. 1.2, and when the power to the motor is cut the cam follower pin 138 moves progressively from position 7 through position 8 to position 9 as shown in FIG. 1.2. It can be seen that with the cam follower pin 138 in either position 1 or position 9 the plunger is at the same axial position since the cam follower pin is at the same axial position.

It can be seen that with each powering of the motor the plunger moves downwards compressing spring 138, and as the power is cut to the motor the plunger moves upwards to one of two heights as spring 148 partially relaxes. Furthermore as the motor is energised the cam follower is caused to rotate through 45 degrees and as the power is cut to the motor the cam follower again rotates in the same direction through a further 45 degrees. Thus four energising/de-energising cycles of the motor will cause the cam follower to rotates through 360 degrees.

It can be seen that when the motor 106 is powered, the plunger 122 always achieves a particular axial position but when the motor is deactivated then the plunger can achieve one of two different axial positions.

The above embodiments demonstrate a way of providing an actuator having differing output positions. Any particular output position can correspond to a powered output position i.e. when the motor is being energised or an at rest position i.e. when the motor has being de-energised. It can be seen it is possible to provide an actuator with differing powered output positions and also differing at rest positions.

Further embodiments may provide for different combinations of powered output position and/or different combinations of rest positions. Furthermore it is clear that each cam arrangement is not limited to only having opposing teeth and it is also clear that the cam follower is not limited to only having two diametrically opposed cam follower.

FIGS. 1.1 to 1.2 show an arrangement with an axially and rotationally fixed caming arrangement which co-operates with a rotatable shuttle in the form of a cam follower. In this case the cam arrangement is in the form of two arrays of teeth on the cam rings which face each other. In an alternative arrangement it is possible to provide a shuttle arrangement rotatably on the plunger with two arrays of teeth which face away from each other and to provide two sets of cam followers, one set for each array of teeth, which are rotatably and axially fixed on the casings.

FIG. 1.3 shows a schematic view of a further embodiment of the present invention in which a shuttle 444 is provided with an array of teeth 445 and a cam follower 446. A caming arrangement is provided by an array of teeth 447 and a cam follower 448, both of which are fixed axially and rotatably fast. The shuttle moves between the teeth 447 and cam follower 448 and is caused to rotate by engagement between teeth 447 and cam follower 445 and by engagement between teeth 445 and cam follower 448.

It can be seen that the cam follower pins of FIGS. 1.1 to 1.3 provide the two functions, namely that of indexing the cam follower rotationally and also of providing stop abutment with the plunger. In alternative embodiments these two functions need not be provided by the same component, thus cam follower pin could solely provide the means for indexing the cam follower rotationally and the axial position of the plunger could be defined an alternative stop arrangement.

Furthermore the preceding description has described how by energising and deactivating a motor, the various output positions can be achieved. It should be noted that it is also possible to achieve any particular output position by applying a force to the plunger, in particular a manual force. Thus sequential pressing and release of for example the plunger 122 of FIG. 1.1 in a downwards direction will cause the cam follower retaining ring to index around allowing the plunger to achieve, in particular, the two at rest output conditions (locked and unlocked). It can be seen that the plunger must pass through the transient condition (position 3 of FIG. 1.2) to change between the locked and unlocked positions.

It should be noted that depending upon the installation, the motor 106 need not necessarily have a centrifugal clutch 110. Furthermore where the means N is not required to be powered, the motor 106 can simply be removed from the casing. This provides for a simply way of providing a powered means and non powered means.

There now follows further examples of means for ensuring the actuatable element passes through the transitory position.

With reference to FIGS. 2.1 to 2.7 there is shown a means M in the form of an actuator 210 including a housing 212, a motor 214, a pivot pin 216, a cam wheel 218 and an output member 220, a housing cover 222 and a spring 224. Housing 212 includes a motor recess 226 and a cam wheel recess 228. Motor assembly 214 includes a motor 230 driveably connectable to an output pinion 232 via a centrifugal clutch 234. Cam wheel 218 includes an array of teeth 236 for engagement with output pinion 232, and a central hole 238 to allow the cam wheel to be pivotably mounted on pivot pin 216. Cam wheel 218 further includes a recess 240 which will be described further below.

Housing cover 222 is generally planar in form and includes a recess (not shown) within boss 242 to receive shaft 231 of motor assembly 214, a recess (not shown) corresponding to cam wheel recess 228, and a lever recess (not shown) within boss 244 to allow the output lever to rotate as will be described further below.

Output member 220 includes levers 246 and 248 and pivot pin 250. Lever 146 includes a cam follower 252 at one end thereof for engagement with recess 240 and a hole 254 at the other end thereof, profiled in such a manner as to engage end 250 of pin 250 in a press fit and rotationally fast manner.

Lever 248 includes a hole 256 at one end thereof connectable in use to a component (not shown) to be actuated. A hole 258 is positioned at the other end of lever 248, profiled to engage in a press fit manner and rotationally fast with end 250B of pivot pin 250. Lever 248 further includes a spring hole 260 through which ends 224A of spring 224 passes. The other end 224B of spring 224 is inserted into spring hole 262 of boss 244.

When assembled:

Motor assembly 214 sits in motor recess 226 with shaft 221 engaging and being supported by the hole within boss 242. Cam wheel 218 sits in recess 228 and the corresponding recess (not shown) of cover 222 with the array of gear teeth 236 in engagement with pinion 232, and central hole 238 being mounted on pivot pin 216 which in turn is mounted in hole 229 of housing 212 and a corresponding hole (not shown) beneath boss 244.

The output member is assembled such that a part of mid portion 251 of pivot pin 250 is pivotally mounted within hole 245 of boss 244, and spring 224 is mounted around an adjacent part of mid portion 251. In particular spring 224 is arranged such that the output member 220 is biased in a clockwise direction when viewed in the direction of arrow A i.e. cam follower 252 is biased in a radially outward direction relative to the axis 216A of pivot pin 216.

When motor 230 is energised the centrifugal clutch 234 will engage, hence driving pinion 232 in an anticlockwise direction when viewed in the direction of arrow A causing the cam wheel to rotate in a clockwise direction when viewed in the direction of arrow A. This rotation of the cam wheel will cause the cam follower 252 to follow the profile of recess 240 and cause the output member to pivotally reciprocate as will be described further below.

Furthermore external reciprocation of the output member 220 (e.g. by manual reciprocation) will cause the cam follower 252 to drive the cam wheel 218 in a clockwise direction. Such rotation causes output pinion 232 to also rotate, though motor 230 is not rotated since the centrifugal clutch 234 is not engaged.

Consideration of FIG. 2.7 shows the cam wheel 218 in more detail. In particular recess 240 includes an outer wall 270 and an inner wall 280 which together form a cam. Outer wall 270 includes two first stops 271A and 271B both located at radius R1 from axis A. Outer wall 270 further includes stops 272A and 272B, both located at radius R2 from axis A. Note that radius R2 is smaller than radius R1. Stops 271A, 271B, 272A and 272B act to limit the outward movement of the cam follower. The profile of the outer wall 270 between stop 271A and 272A is split into three distinct portions 273, 274 and 275. Spirally curved portion 273 starts at stop 271A at circumferential position C1 and spirals inwards to edge 276A at radius R3 and circumferential position C2. It should be noted that radius R3 is less than radius R1.

For the avoidance of doubt term inward spiral refers to a curved traced by a point which rotates about a fixed position towards which it continually approaches, and the term outward spiral should be construed accordingly. In particular a straight line is a special form of curve and the term spiral curve includes for example and embodiment wherein stop 271A is connected to edge 276A by a straight line.

It should be noted that the exact form of spirally curved portion 273 can be varied, for example it could be part of an archimedian spiral, part of a circle, part of an ellipse, or other forms. The significant point is that point 276A is circumferentially displaced from stop 271A and is radially closer to axis A than stop 271A.

Portion 274 is substantially radially orientated. Portion 275 comprises an outward spirally curved portion. The portion of outer wall between stop 272A and 271B has equivalent inwardly spirally curved portion 277, substantially radially orientated portions 278 and outwardly spirally curved portion 279.

In particular it should be noted that portion 278 should be regarded as a substantially radially orientated portion even though in fact it is part of an arc, the centre of which is the axis of pivot pin 270 when the cam follower is situated adjacent this portion of the outer wall. The form of portion 278 thus allows the cam follower to move substantially radially relative to axis A without causing the cam wheel to rotate. Three corresponding portions (not marked for clarity) can be identified between stop 271B and stop 272B and three corresponding portions (not marked for clarity) can be identified between stop 272B and stop 271A.

With reference to FIG. 2.8 it can be seen that inner wall 280 includes third stops 281A, 281B, 281C and 281D, all positioned at radius R3 from axis A. Consideration of the outer wall profiled between stop 281A and 281B shows a substantially radially orientated portion 282 and an inwardly spirally curved portion 283.

The profile of the inner wall between stops 281B and 281C includes a substantially radially orientated portion 284 and an inwardly spirally curved portion 285. Equivalent portions (not marked for clarity) can be identified between stops 281C and 281D and also between stops 281D and 281A. It should be noted that the circumferential position C4 of inner stop 281B is circumferentially between the circumferential positions C1 and C3 of outer stops 271A and 272A respectively.

Furthermore it can be seen that the circumferential position C4 of stop 281B is circumferentially offset (misaligned) from edge 286 (positioned at circumferential position C5) edge 286 is also circumferentially offset from stop 272A (compare positions C5 and C3).

Powered operation of the actuator is as follows:

Consideration of FIG. 2.3 shows the actuator in a stationary position with the cam follower 252 being biased in a radially outward direction by spring 224. Cam 252 is limited in its outward movement by engagement with stop 272A.

The motor is energised such that the cam wheel is caused to rotate in a clockwise direction whereupon portions 277, 278 and 279 progressively move past cam follower 252. As portion 277 moves pass cam follower 252 the cam follower progressively moves radially inwardly relative to axis A causing the output member 220 to rotate in an anticlockwise direction about axis B.

As the end of portion 277 adjacent portion 278 moves pass cam follower 252, the output member 'snaps' clockwise under the influence of spring 224 until such time as the cam follower 252 abuts the end of portion 279 adjacent portion 278. Continued rotation of the cam wheel 218 in a clockwise direction causes the portion 279 to move pass cam follower 252 until such time as the actuator achieves the position as shown in FIG. 2.4 whereupon cam follower 252 engages stop 271B.

It should be noted that due to the radial difference between stop 272A and 271B the output member 220 is in a different position when comparing FIGS. 2.3 and 2.4. It should be noted that motor 230 is energised with a pulse of predetermined duration and provided that edge 276A has passed under cam follower 252 and provided that edge 276B has not passed under cam follower 252 then whenever the pulse of energy ceases with the cam follower between these two edges, the spring 224 will cause the cam wheel to return or advance to the position as shown in FIG. 2.4 since this is the radially outer most position achievable by the cam follower between edges 276A and 276B.

A further pulse of energy to motor 230 will cause stop 272B to move beneath the cam follower. Note that at this position the output member 200 will be in the position as shown at FIG. 2.3 but the cam wheel will be rotated 180 degrees from the position as shown in FIG. 2.3. A further pulse of energy to the motor will move stop 271A beneath cam follower 252 and a yet further pulse of energy will move stop 272A beneath cam follower 252 returning the actuator to the position as shown in FIG. 2.3.

Note that during powered operation cam follower 252 only need engage the outer wall 270 and no contact is required between cam follower 252 and inner wall 280.

It is possible to externally actuate the output member 220 to rotate the cam wheel 218 under these circumstances the sequence of movements are shown sequentially in FIG. 2.3, FIG. 2.5, FIG. 2.4 and FIG. 2.6.

Thus manual actuation of the output member 200 in an anticlockwise direction about axis B causes cam follower 252 to disengage the outer wall and engage the inner wall at portion 285, since edge 286 is circumferentially offset from stop 272A. Continued anticlockwise movement of output member 220 results in cam follower 252 moving substantially radially inwardly relative to axis A causes a camming action between cam follower 252 and portion 285 resulting in clockwise rotation of cam wheel to the position as shown in FIG. 2.5, whereupon cam follower 252 engages stop 281C.

Release of output member 220 results in output member snapping clockwise under the influence of spring 224 until such time as cam follower 252 engages an end of portion 279 of the outer wall. Spring 224 continues to basis cam follower 252 in a radially outward direction resulting in the camming action between cam follower 252 and portion 279 until such time as the actuator achieves the position as shown in FIG. 2.4.

A further manual actuation of the output member in an anticlockwise direction about axis B causes cam follower 252 to disengage the outer wall and engage the inner wall at portion 280 causing the actuator to move to the position as shown in FIG. 2.6. Subsequent release of the output member will cause this component to move to the position as shown in FIG. 2.3 under the influence of spring 224 (though it should be noted that the cam wheel will be positioned 180 degrees from the position as shown in FIG. 2.3).

Thus it can be seen that progressive pulses of energy to the motor can cause the output member to move between the position as shown in FIGS. 2.3 and 2.4. Furthermore the output member can be caused to move between these two positions by successive manual or other external actuation of the output member 220.

As mentioned above, the spring 224 acts to bias the cam follower radially outwardly relative to the cam wheel axis. A person skilled in the art would readily appreciate that it is also possible to arrange the spring to bias the cam follower radially inwardly and to provide an appropriate cam formation. Any form of motor can be used but in particular DC electric motors are particularly suitable as are electric stepper motors.

The embodiment described show a cam follower in the form of a pin which is positioned in a groove which provides for the cam profile. In further embodiments different cam profile and cam follower arrangements could be used in particular a twin pronged fork cam follower could be used with a fork being provided on either side of a rail, the rail being shaped to provide the cam profile The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A lock arrangement comprising:

a lock having an unlocked and a locked condition, the lock arrangement further including an actuable element having a first position at which the lock is in said unlocked condition and a second position at which the lock is in said locked condition, the lock arrangement further including a mechanism for ensuring the actuable element passes through a transitory position in changing the state of the lock from at least one of the locked and the unlocked conditions to the other of the locked and the unlocked conditions in which one of the first and second positions of the actuable element is on a path of the actuable element between the transitory and the other of the first and second positions; and a latch having a locked condition and a released condition, wherein the lock arrangement is operable to lock the latch and wherein the actuable element further has a release position at which the latch is set to the released condition.

2. The lock arrangement as defined in claim 1 in which the mechanism ensures the actuable element passes through the transitory position when changing the state of the lock from the locked condition to the unlocked condition.

3. The lock arrangement as defined in claim 1 in which the mechanism ensures the actuable element passes through the transitory position when changing the state of the lock from the unlocked condition to the locked condition.

4. The lock arrangement as defined in claim 1 in which the actuable element is biased away from the transitory position.

5. The lock arrangement as defined in claim 1 in which the mechanism has an output element having a first, a second and a transitory positions corresponding to the first, the second and the transitory positions of the lock arrangement, the first, the second and the transitory positions of the mechanism being in line on an axis.

6. The lock arrangement as defined in claim 5 in which the mechanism includes a shuttle rotatably indexable about the axis during movement between the first and the transitory position or the second and the transitory position of the mechanism, the shuttle acting as a stop to provide the first, the second and the transitory positions.

7. The lock arrangement as defined in claim 6 in which the shuttle is a cam follower movable between opposing arrays of cam teeth.

8. The lock arrangement as defined in claim 6 in which the shuttle includes a cam follower and an array of cam teeth and moves between an array of teeth which oppose a further cam follower.

9. The lock arrangement as defined in claim 6 in which the shuttle includes two opposing cam followers, wherein two arrays of cam teeth facing away from each other move between the two opposing cam followers.

10. The lock arrangement as defined in claim 1 in which the mechanism has an output element having a first, a second and a transitory positions corresponding to the first and the second and the transitory positions of the lock arrangement, the first, the second and the transitory positions of the mechanism being an arc of a circle.

11. The lock arrangement as defined in claim 10 in which the mechanism includes a cam follower pivotable about a center of the arc which engages a cam rotatable about a cam axis different from the center of the arc.

12. The lock arrangement as defined in claim 11 in which the cam includes a first and a second stop corresponding to the first and the second positions of the output element.

13. The lock arrangement as defined in claim 12 in which the stops limit radially outward movement of the cam follower relative to the cam.

14. The lock arrangement as defined in claim 13 in which the stops limit radially inward movement of the cam follower relative to the cam.

15. The lock arrangement as defined in claim 11 in which the cam includes a transitory position stop corresponding to the transitory position of the output element.

16. The lock arrangement as defined in claim 15 in which the transitory position stop limits radially inward movement of the cam follower relative to the cam.

17. The lock arrangement as defined in claim 15 in which the transitory stop limits radially outward movement of the cam follower relative to the cam.

18. The lock arrangement as defined in claim 1 in which the mechanism includes a motor operable to change the state of the lock.

19. The lock arrangement as defined in claim 18 in which the motor is powered in a single direction to move the actuable element from the locked to the unlocked condition and from the unlocked to the locked condition.

20. The lock arrangement as defined in claim 18 in which the mechanism has an output element having a first, a second and a transitory positions corresponding to the first, the second and the transitory positions of the lock arrangement, the first, the second and the transitory positions of the mechanism being in line on an axis and a shuttle rotatably indexable about the axis during movement between the first and the transitory position or the second and the transitory position of the mechanism, the shuttle acting as a stop to provide the first, the second and the transitory positions, in which the mechanism includes a motor operable to change the state of the lock and in which the motor drives the shuttle.

21. The lock arrangement as defined in claim 18 in which the mechanism has an output element having a first, a second and a transitory positions corresponding to the first and the second and the transitory positions of the lock arrangement, the first, the second and the transitory positions of the mechanism being an arc of a circle and includes a cam follower pivotable about a center of the arc which engages a cam rotatable about a cam axis different from the center of the arc, in which the mechanism includes a motor operable to change the state of the lock and in which the motor drives the cam.

22. The lock arrangement as defined in claim 1 in which the actuable element is a sill button.

23. The lock arrangement as defined in claim 1 in which the actuable element is an inside door handle.

* * * * *

UNITED STATES PATENT AND TRADEMARK OFFICE

CERTIFICATE OF CORRECTION

PATENT NO. : 6,609,737 B2
DATED : August 26, 2003
INVENTOR(S) : Sidney Edward Fisher It is certified that error appears in the above-identified patent and that said Letters Patent is hereby corrected as shown below:

Title page,
Before item [51], insert item Foreign Application Priority Data
Nov. 29, 2000 ……. 0029064.3 (GB) --

Signed and Sealed this

Ninth Day of December, 2003

JAMES E. ROGAN
*Director of the United States Patent and Trademark Office*